United States Patent [19]

Chari

[11] Patent Number: 5,015,564

[45] Date of Patent: May 14, 1991

[54] STABILIZATION OF PRECIPITATED DISPERSIONS OF HYDROPHOBIC COUPLERS, SURFACTANTS AND POLYMERS

[75] Inventor: Krishnan Chari, Rochester, N.Y.

[73] Assignee: Eastman Kodak Company, Rochester, N.Y.

[21] Appl. No.: 531,657

[22] Filed: Jun. 1, 1990

Related U.S. Application Data

[62] Division of Ser. No. 288,922, Dec. 23, 1988, Pat. No. 4,957,857.

[51] Int. Cl.[5] ..... G03C 7/26; G03C 7/32; G03C 7/34

[52] U.S. Cl. ..... 430/546; 430/552; 430/553; 430/558; 252/251; 106/22; 106/493

[58] Field of Search ..... 430/546, 558, 552, 553; 252/351; 106/22, 493

[56] References Cited

U.S. PATENT DOCUMENTS

| | | | |
|---|---|---|---|
| 2,322,027 | 6/1943 | Jelley et al. | 430/546 |
| 2,870,012 | 1/1959 | Godowsky et al. | 96/97 |
| 3,449,123 | 6/1969 | Kondo et al. | 96/100 |
| 3,649,287 | 3/1972 | DePauw et al. | 96/100 |
| 3,658,546 | 4/1972 | Van Doorselaer et al. | 430/546 |
| 3,730,726 | 5/1973 | Tsuti et al. | 430/510 |
| 3,860,425 | 1/1975 | Ono et al. | 96/82 |
| 3,912,517 | 10/1975 | Van Poucke et al. | 96/100 |
| 3,963,499 | 6/1976 | Shiba et al. | 96/100 |
| 4,140,530 | 2/1979 | Trunley et al. | 96/67 |
| 4,211,836 | 7/1980 | Yoneyama et al. | 430/449 |
| 4,275,145 | 6/1981 | Mikami | 430/377 |
| 4,291,113 | 9/1981 | Minamizono et al. | 430/546 |
| 4,379,836 | 4/1983 | Schnöring et al. | 430/449 |
| 4,385,110 | 5/1983 | Yoneyama et al. | 430/372 |
| 4,388,403 | 6/1983 | Helling et al. | 430/546 |
| 4,419,440 | 12/1983 | Kohnert et al. | 430/377 |
| 4,443,536 | 4/1984 | Lestina | 430/552 |
| 4,490,461 | 12/1984 | Webb et al. | 430/510 |
| 4,933,270 | 6/1990 | Bagchi | 430/546 |
| 4,970,139 | 11/1990 | Bagighi | 430/449 |

FOREIGN PATENT DOCUMENTS

| | | | |
|---|---|---|---|
| 0182658 | 5/1986 | European Pat. Off. . | |
| 284240 | 9/1988 | European Pat. Off. . | |
| 2827519 | 5/1977 | Fed. Rep. of Germany . | |
| 2902327 | 7/1979 | Fed. Rep. of Germany | 430/546 |
| 74-53874 | 7/1974 | Japan . | |
| 99416 | 8/1979 | Japan | 430/546 |
| 1038029 | 8/1966 | United Kingdom . | |
| 1052487 | 12/1966 | United Kingdom . | |
| 1603884 | 12/1981 | United Kingdom . | |

OTHER PUBLICATIONS

Van Veelen, Photographic Science and Engineering, The Morphology of Color Images Formed by Color Development with Substantive Couplers, vol. 15, No. 3, Jun. 1971, pp. 242–250.

Gutoff et al., AIChe Symposium Series, Dispersions of Spherical Dye Particles By Continuous Precipitation, vol. 76, No. 193, pp. 43–51.

William J. Priest, Research Disclosure 16468, Process for Preparing Stable Aqueous Dispersions of Certain Hydrophobic Materials, Dec. 1977, pp. 75–80.

*Primary Examiner*—Charles L. Bowers, Jr.
*Assistant Examiner*—Patrick A. Doody
*Attorney, Agent, or Firm*—Paul A. Leipold

[57] ABSTRACT

The invention provides stable dispersions of couplers and methods of their formation. The stable dispersions are formed by the use of a nonionic water soluble polymer in combination with an anionic surfactant having a sulfate or sulfonate head group and a hydrophobic group of 8 to 20 carbons. The preferred nonionic water soluble polymers are polyethyleneoxide and polyvinylpyrrolidene.

11 Claims, No Drawings

STABILIZATIN OF PRECIPITATED DISPERSIONS OF HYDROPHOBIC COUPLERS, SURFACTANTS AND POLYMERS

This is a divisional of application Ser. No. 288,922, filed Dec. 23, 1988 now U.S. Pat. No. 4,957,857.

FIELD OF THE INVENTION

The present invention concerns a method for forming stable dispersed particles of photographic components for photographic systems. It particularly relates to the stable dispersion of photographic coupler materials.

PRIOR ART

The art of precipitation of hydrophobic coupler for photographic systems, starting from a solution state, to a stable fine particle colloidal dispersion is known. This is generally achieved by dissolving the coupler in a water miscible solvent aided by addition of base to ionize the coupler, addition of a surfactant with subsequent precipitation of the photographic component by lowering the pH, or by shift in concentration of the two or more miscible solvents, such that the photographic component is no longer soluble in the continuous phase and precipitates as a fine colloidal dispersion.

In United Kingdom Patent 1,193,349, Townsley et al discloses a process whereby a color coupler is dissolved in a mixture of water miscible organic solvent and aqueous alkali. The solution of color coupler is then homogeneously mixed with an aqueous acid medium including a protective colloid. Thus was formed a dispersion of precipitated color coupler by shift of pH, and this dispersion of color coupler when mixed with a dispersion of an aqueous silver halide emulsion and coated on a support, was incorporated into a photographic element.

In an article in Research Disclosure 16468, December 1977, pages 75–80 entitled "Process for Preparing Stable Aqueous Dispersions of Certain Hydrophobic Materials" by W. J. Priest, published by Industrial Opportunities Ltd., The Old Harbormaster's, 8 North Street Emsworth, Hants P 010 7DD U.K. a method of forming stable aqueous dispersions of hydrophobic photographic material was disclosed. The process of Priest involves the formation of an alkaline aqueous solution of an alkali soluble color forming coupler compound in the presence of a colloid stabilizer or polymeric latex. The alkali solution is then made more acidic in order to precipitate coupler. The particles of color-forming coupler compounds are stabilized against excessive coagulation by adsorption of a colloid stabilizer.

U.S. Pat. No. 2,870,012 Godowsky et al discloses formation of a finely divided suspension of a coupler by precipitation caused by solvent shift. Also disclosed is utilization of a surfactant that is a dioctyl ester of sodium sulfosuccinic acid as a wetting or dispersing agent. It is indicated in Godowsky et al that the materials are stable for a long period of time after removal of the solvent.

U.S. Pat. No. 4,388,403 Helling et al discloses the formation of dispersions of polymers that are stable for long periods of time and useful in photographic processes.

While all of the above processes have been somewhat successful for some color photographic materials, there remain difficulties in obtaining stable dispersions of couplers having short hydrocarbon chains as ballast groups by condensation from solution. These couplers, unlike those successfully utilized in the prior art, are not stable when left for several days at room temperature after being formed as particle dispersions by solvent and/or pH shifting. The particle sizes increase and the particles may gel or precipitate. There is a need for a method of making such dispersions of these couplers that are stable.

THE INVENTION

The invention provides a method of forming a stable dispersion of hydrophobic couplers having short hydrocarbon chain ballast groups of up to 15 carbons. This stable dispersion is formed by the use of a nonionic water soluble polymer in combination with an anionic surfactant having a sulfate or sulfonate head group and a hydrophobic group of 8 to 20 carbons. The surfactant further does not have oxyethylene groups. The preferred nonionic water soluble polymers are polyethyleneoxide and polyvinylpyrrolidone. The preferred couplers that form stable dispersions by this system are couplers 1–4 as follows:

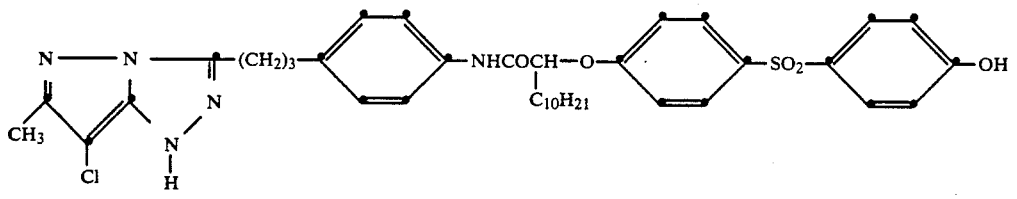

(1)

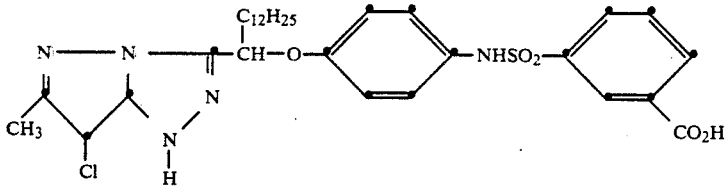

(2)

-continued

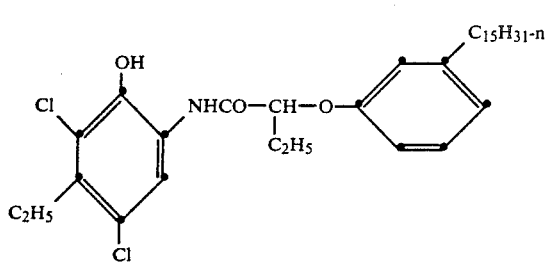

(3)

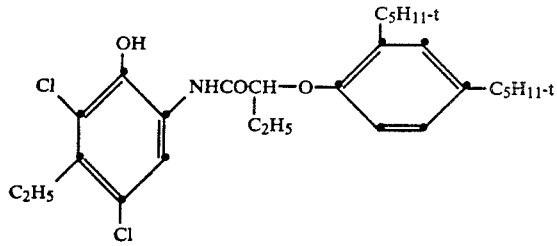

(4)

MODES OF PERFORMING THE INVENTION

There are numerous advantages in the invention in that the short chain ballasted couplers may now be formed in the small particles available by preparation of colloidal dispersions by condensation techniques. Further, the dispersions formed are stable for longer than three days at room temperature without agitation or other special conditions. While it has been known to form storage stable small particle dispersions of other couplers, the couplers of the invention have not been suitably formed as small particle dispersions with good storage properties. The method of the invention allows formation of such small particle dispersions efficiently and at low cost. The dispersions of the invention and their formation method are set forth below.

Generally the invention is performed by forming a basic solvent solution of a short chain ballasted coupler. An aqueous solution of a nonionic water soluble polymer and an anionic surfactant, having a sulfate or sulfonate head group, a hydrophobic group of 8 to 20 carbons and not having oxyethylene groups is also formed. The solvent coupler solution and the aqueous solution, containing the surfactant and nonionic water soluble polymer, are combined and immediately neutralized to a pH of about 6. The basic solvent normally has been made a basic solution by the addition of a base, such as sodium hydroxide to a solvent such as an alcohol. After the combination of the solvent and water solutions and neutralization or addition of acid to precipitate the dispersion of solid coupler particles, the dispersion is washed using a dialysis membrane to remove the solvent.

While not relying on any particular theory or explanation for the success of the invention, it is believed that the reason dispersions prior to the invention do not stay stable is that particle growth takes place by Ostwald ripening and Brownian coagulation. Ostwald ripening occurs by dissolution of some particles while other particles grow larger. Brownian coagulation occurs when the random movements of the particles cause them to collide and then unite together. It is theorized that the surfactant of the invention joins to the particles with the head group extending away from the particles. The nonionic polymer then Joins with the extending head groups and, in some way, coats and prevents dissolution of the particles rendering the dispersion stable.

The invention is believed to require interaction between the surfactant and the nonionic water soluble polymer to form a complex of the water soluble polymer and the surfactant molecules. While the role of the polymer combined with the surfactant in retarding growth by Ostwald ripening is not fully understood, it is believed sin:e Ostwald ripening involves the transfer of material from smaller particles to larger ones, it is possible that the adsorbed nonionic water soluble polymer provides a resistance to the dissolving of the coupler from the smaller particle and possibly also resists the addition of dissolved material to a particle. Thus, the invention combination of nonionic water soluble polymer and the specific anionic surfactants act to shield the dispersed particles of coupler from dissolving and from growth. While the surfactants and nonionic water soluble polymers have been individually utilized in dispersion processes prior to the invention, the combination of these materials was not known to have any beneficial effect in stabilization of coupler dispersions of the hydrophobic couplers dispersed by the method of the invention.

The couplers of the invention may be any coupler that is stabilized after preparation as a colloidal dispersion by condensation by the combination of the anionic surfactant and nonionic water soluble polymer of the invention. The couplers suitable for use in the invention are those couplers having short chain hydrocarbon ballast groups. Short chain is used here to mean those hydrocarbon chains of up to 15 carbons. Couplers with which stable dispersions can be formed beneficially in accordance with this invention can be represented by the structure:

$$\text{COUP-BALL}_{|\,R}$$

where:

COUP is a coupler moiety, $$\text{BALL}_{|\,R}$$

is a ballast group, and

R is a hydrocarbon chain of 2 to 15 carbon atoms.

Typically, R is an unsubstituted alkyl group of 2 to 15 carbon atoms.

where the unsatisfied bond is joined to a non-coupling position of the coupler moiety:

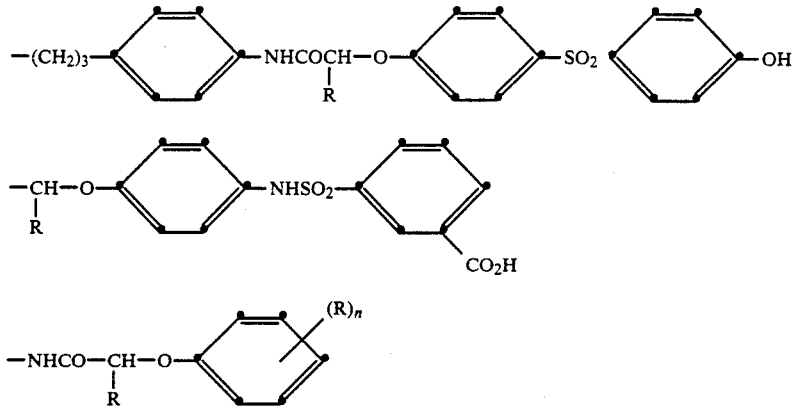

The coupler moiety represented by COUP can be any of the coupler moieties known in the art. Typically, COUP is a dye forming coupler moiety, e.g., a yellow dye forming coupler moiety such as an acylacetanilide or an aroylmethane, a magenta dye-forming coupler moiety such as a pyrazolone or a pyrazoloazole, or a cyan dye-forming coupler moiety such as a phenol or a naphthol.

The ballast group, BALL-R, is joined to a non-coupling position of the coupler moiety. Representative ballast groups have one of the following structures, where R is alkyl of 2 to 15 carbon atoms, and n is 1 or 2.

The couplers preferred for the invention in view of their greatly increased stability of dispersion are as follows:

(1)

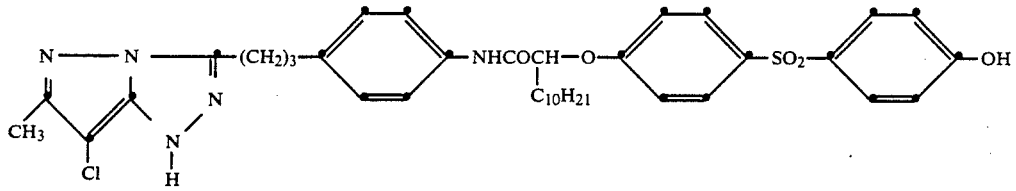

(2)

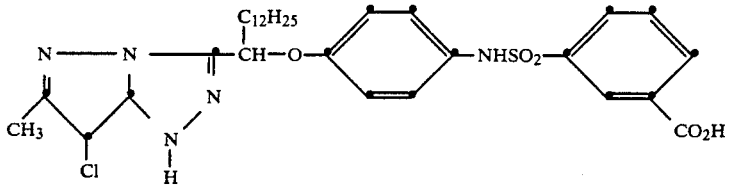

(3)

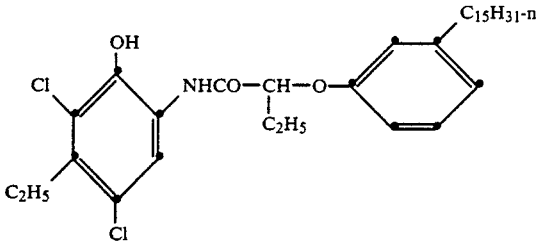

(4)

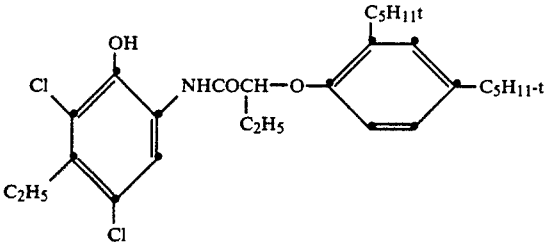

It can be seen that the ballast chains of these couplers are 10 carbons for 1, 12 carbons for 2, 15 carbons for 3, and 2 chains of 5 carbons for 4.

The water miscible solvent for dissolving the hydrophobic coupler may be any solvent capable of dissolving the coupler without decomposing the coupler. Suitable solvents include methanol, propanol, isopropyl alcohol and butyl alcohol.

The surfactants for the invention are any anionic surfactant having a sulfate or sulfonate head group. The head group is the group on the surfactant that extends away from the particle into the water in which the particles disperse. The other portion of the surfactant is a hydrophobic group of 8 to 20 carbons that will lie on the surface of the coupler particle. The surfactant does not have oxyethylene groups which would interfere with forming the stable dispersions of the invention. The sulfate or sulfonate group may be represented as an $SO_3M$ or $OSO_2M$ moiety where M represents a cation. M most commonly is sodium. Typical of surfactants suitable for the invention are those as follows:

$C_{12}H_{25}OSO_3Na$ A-1

$C_{14}H_{29}OSO_3Na$ A-2

$C_{12}H_{25}CONHCH_2CH_2OSO_3Na$ A-3

$C_{12}H_{25}SO_3Na$ A-4

$C_{14}H_{29}SO_3Na$ A-5

$NaO_3S-CH(CH_2COOC_8H_{17})-COOC_8H_{17}$ A-6

A-7

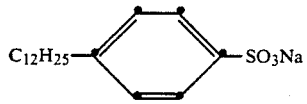

A-8

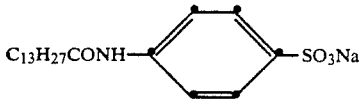

A-9

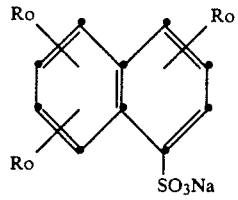

Ro represents $-CH(CH_3)_2$

A-10

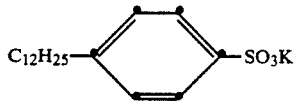

A-11

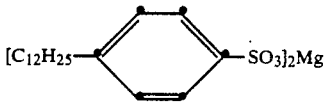

Preferred surfactants of the invention are sodium bis(2 ethyl hexyl) sulfosuccinate, sodium tetradecyl sulfate, sodium dodecyl sulfate and sodium dodecyl benzene sulfonate as they form dispersions that are stable for long periods of time.

The nonionic water soluble polymer utilized in the invention may be any nonionic water soluble polymer that is composed of polar and non polar groups and is attracted to the head group of the surfactant being utilized and acts with the surfactant to prevent the increase in particle size of the dispersed coupler during storage. Typical of such polymers are polypropylene oxide, polyvinyl alcohol, and methylcellulose. Suitable polymers are polyethylene oxide and polyvinylpyrrolidone. The polyvinylpyrrolidone is preferred as it results in the most uniform and storage stable particles.

The base added to the solvent is any material that will be stable in solvent and in water while raising the pH of the solvent solution to at least 10. A preferred material for the alcohol solvent system of the invention is sodium hydroxide as it is effective in small amounts, stable, and low in cost.

The term "storage stable" as utilized in this invention is intended to mean that dispersions of the invention are stable for at least three weeks when stored at room temperature (about 20° C.) without agitation. The stable dispersions have no settling of material during the three day storage. The median particle size of the typical dispersion of the invention is between about 8 and about 300 nm.

The following examples are intended to be illustrative of the invention. Parts and percentages are by weight unless otherwise indicated.

Example 1

9.0 ml of n Propanol was added to 4.32 g of Coupler No. 1, and the mixture was heated to 60° C. with stirring. 6 ml of 1M NaOH was then added and the stirring continued until the coupler dissolved. The solution was then allowed to cool down to room temperature. 2.16 g of polyvinylpyrrolidone (mv 40,000) was dissolved in 150 ml of a 0.01 m/l solution of sodium dodecylbenzene sulfonate. The surfactant solution was added to the dissolved coupler. A solution of acetic acid was then added to lower the pH to 6 and form the dispersion. The dispersion was washed for four hours using a dialysis membrane tubing to remove auxiliary solvent. Just after preparation, the average particle size in the dispersion was 0.03 microns. A sample of the dispersion was incubated at 45° C, for 31 hours. The average particle size after incubation was 0.05 microns, and no settling had occurred.

Example 2 (Control)

4.32 grams of the coupler Number 1 was weighed into a 50 ml beaker. 9.0 ml of n propanol was then added to the coupler. The mixture was heated 60° C. and stirred until the coupler dissolved. To the dissolved coupler was added 6.0 ml of one molar aqueous sodium hydroxide solution. The composition was allowed to cool to room temperature. 2.16 grams of polyvinylpyrrolidone was dissolved in 150 ml of distilled water with stirring. The polymer solution was added to the dissolved coupler at room temperature with stirring. A 15% acetic acid solution was then added with stirring. A thick white precipitate was formed on addition of the acid. The PH of the composition before acidification was 11.2.

Example 3

A mixture of 3.0 ml of n propanol and 4.0 ml of one molar sodium hydroxide solution was added to 2.0 g of the coupler No. 2 at room temperature (22° C.) with stirring until the coupler dissolved.

1.0 g of polyvinylpyrrolidone (mol. wt 40000) was dissolved in 80 ml of a 0.01 m/l aqueous solution of sodium dodecyl sulfate. The aqueous surfactant solution was added to the dissolved coupler. A solution of acetic acid was then added to lower the pH to 6. A clear dispersion of the coupler was formed. The dispersion was washed for four hours using a dialysis membrane tubing to remove the propanol. The washed dispersion had a coupler content of 2% by weight. An analysis by HPLC showed that essentially no decomposition of the coupler had occurred during the process of making the dispersion. The particle size in the dispersion as determined by photon correlation spectroscopy was 9.7 nm. A portion of the dispersion was incubated at 45° C. After 24 hours at 45° C., the dispersion remained stable and there was almost no change in particle size. The dispersion was stable when mixed with gelatin.

Example 4 (Control)

A dispersion prepared using the same procedure as Example 3, but without polyvinylpyrrolidone, deteriorated with particle growth and settling occurring in less than 24 hours at 45° C.

Example 5

6.0 ml of n propanol was added to 3.0 g of the coupler 4, and the mixture heated to 72° C. with stirring until the coupler dissolved.

6.0 ml of one molar sodium hydroxide was then added to the dissolved coupler with stirring. The solution was allowed to cool to room temperature (22° C.). 1.5 g of polyvinylpyrrolidone (mol. wt 40000) was dissolved in 150 ml of 0.01 m/l sodium dodecyl sulfate. The surfactant solution was added to the dissolved coupler. A solution of acetic acid was then added to lower the pH to 6. The dispersion was washed for four hours using a dialysis membrane tubing to remove the propanol. The washed dispersion had a coupler content of 1.8%. An analysis by HPLC showed that essentially no decomposition of the coupler had occurred during the process of making the dispersion. The particle size in the dispersion as determined by photon correlation spectroscopy was 250 nm. A portion of the dispersion was incubated at 45° C. After 24 hours at 45° C., the dispersion remained stable and there was almost no change in the particle size. The dispersion was stable when mixed with gelatin. A second portion of the dispersion was kept at room temperature for one month. It was found that almost no change in particle size had occurred during that period.

Example 6 (Control)

The process of Example 5 repeated, but without the polyvinylpyrrolidone, deteriorated to a paste after two days at room temperature.

Example 7

6.0 ml of n propanol was added to 2.0 g of the coupler 3, and the mixture was heated to 50° C. and stirred until the coupler dissolved. 4.0 ml of one molar sodium hydroxide was then added to the dissolved coupler with stirring. 0.25 g of sodium dodecyl sulfate and 1.0 g of polyvinylpyrrolidone (mol. wt 40000) were then added. Stirring was continued until a clear solution was obtained. The solution was allowed to cool to room temperature (22° C.), and 60 ml of distilled water was added to it. A solution of acetic acid was added to lower the pH to 6. A clear dispersion of the coupler was formed. The dispersion was washed with distilled water for four hours using a dialysis membrane tubing to remove the propanol. The washed dispersion had a coupler content of 2.5% by weight. The particle size in the dispersion as determined by photon correlation spectroscopy was 10 nm. A sample of the dispersion was incubated at 45° C. After 24 hours at 45° C. the dispersion was stable and showed only a moderate increase in size to 15 nm. The dispersion was also stable when mixed with gelatin.

Example 8 (Control)

A dispersion prepared using the same procedure as Example 7 but without polyvinylpyrrolidone and subjected to the same incubation test at 45° C. showed significant deterioration with floc formation in less than 24 hours.

From review of the above examples it can be seen that the invention combination of surfactant and nonionic polymer provides stable dispersions of couplers that are unable to be stabilized in dispersions by the use of only surfactants. The control examples illustrate the failure of systems that are not stabilized by both the polymer and the surfactant.

It will be understood that the examples and discussion above are intended to be illustrative only of the invention and that the invention is to be taken as limited only by the scope of the claims attached hereto.

I claim:

1. A dispersion comprising water, and particles, said particles consisting essentially of a coupler having a ballast group comprising a straight chain hydrocarbon of up to 15 carbon atoms, a surfactant comprising a head group of sulfate or sulfonate and having no oxyethylene groups, and a nonionic water soluble polymer that is attracted to said surfactant with the proviso that said dispersion does not precipitate after three weeks' storage.

2. The dispersion of claim 1 wherein said coupler comprises a member selected from the group consisting of:

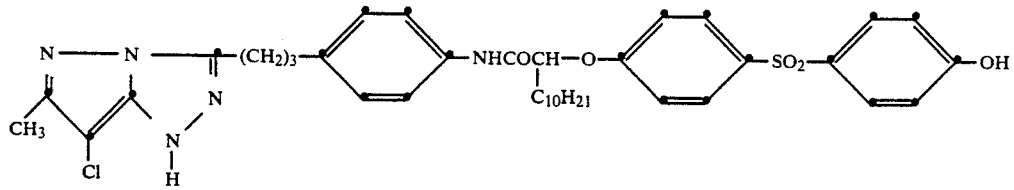

-continued

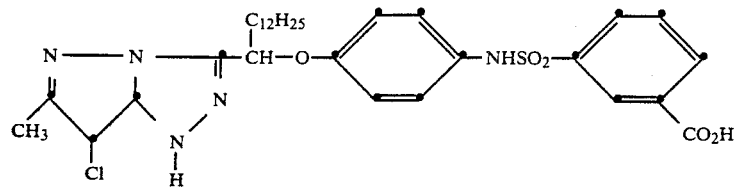

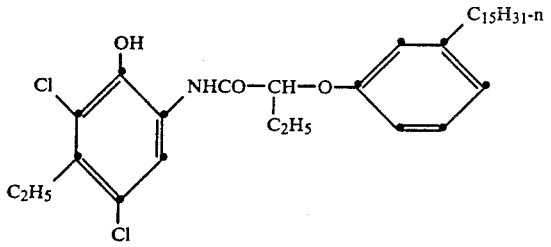

and

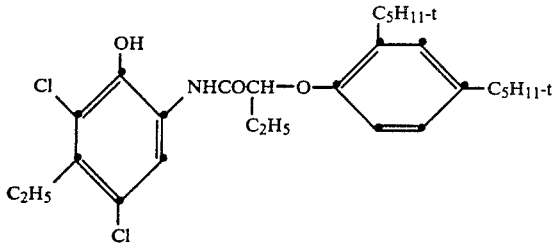

3. The dispersion of claim 1 further comprising gelatin.

4. The dispersion of claim 1 wherein said water soluble polymer comprises polyvinylpyrrolidone.

5. The dispersion of claim 4 wherein said surfactant has a tail group that comprises a hydrophobic group of 8 to 20 carbons, said surfactant does not have oxyethylene groups, and wherein said sulfate or sulfonate may be represented as an $SO_3M$ or $OSO_3M$ moiety where M represents a cation.

6. The dispersion of claim 1 wherein the median particle size of said coupler particles is between about 8 and about 300 nm.

7. The dispersion of claim 5 wherein M represents sodium.

8. The dispersion of claim 5 wherein said coupler has the structure

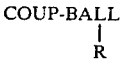

wherein

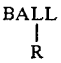

is a ballast group, and

R is a hydrocarbon chain of 2 to 15 carbon atoms.

9. The dispersion of claim 8 wherein R is an unsubstituted alkyl group of 2 to 15 carbon atoms.

10. The dispersion of claim 9 wherein said ballast group is joined to a non-coupling position of said coupler moiety and has a structure selected from the group consisting of

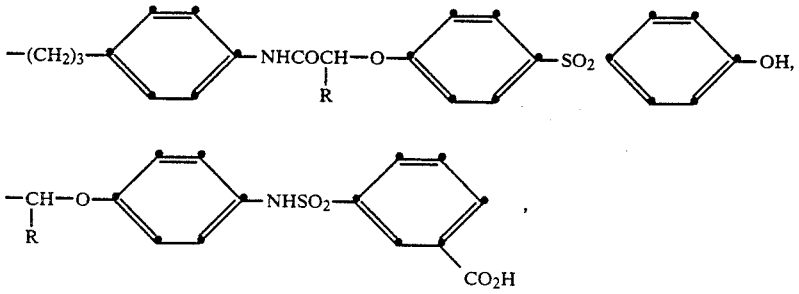

and

-continued
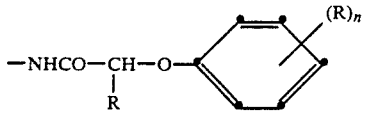
where R is an alkyl of 2 to 15 carbons and n is 1 or 2.
11. The dispersion of claim 6 wherein said water soluble polymer comprises polyvinylpyrrolidone.
* * * * *

UNITED STATES PATENT AND TRADEMARK OFFICE

CERTIFICATE OF CORRECTION

PATENT NO. : 5,015,564

DATED : May 14, 1991

INVENTOR(S) : Krishnan Chari

It is certified that error appears in the above-identified patent and that said Letters Patent is hereby corrected as shown below:

In Column 12, line 39, after "wherein" insert - - COUP is a coupler moiety, - -

In Column 12, line 48, delete "9" and insert - -8- -.

Signed and Sealed this

Twenty-second Day of December, 1992

*Attest:*

DOUGLAS B. COMER

*Attesting Officer*

*Acting Commissioner of Patents and Trademarks*